US008302332B2

(12) United States Patent
Leach

(10) Patent No.: US 8,302,332 B2
(45) Date of Patent: Nov. 6, 2012

(54) REMOVABLE SPIKE FOR FOOTWEAR

(75) Inventor: Craig Leach, Gilston (AU)

(73) Assignee: Raptors Sports Pty Ltd, Gilston (AU)

( * ) Notice: Subject to any disclaimer, the term of this patent is extended or adjusted under 35 U.S.C. 154(b) by 546 days.

(21) Appl. No.: 12/505,310

(22) Filed: Jul. 17, 2009

(65) Prior Publication Data

US 2009/0307933 A1 Dec. 17, 2009

Related U.S. Application Data

(63) Continuation-in-part of application No. PCT/AU2007/001840, filed on Nov. 28, 2007.

(30) Foreign Application Priority Data

| | | |
|---|---|---|
| Dec. 8, 2006 | (AU) | 2006249284 |
| Apr. 24, 2007 | (AU) | 2007201821 |
| Jan. 21, 2009 | (AU) | 2009900213 |
| Jan. 23, 2009 | (AU) | 2009900270 |

(51) Int. Cl.
*A43B 5/00* (2006.01)
*A43C 15/02* (2006.01)

(52) U.S. Cl. ..... 36/134; 36/127

(58) Field of Classification Search ..... 36/134, 36/127, 67 D, 59 R
See application file for complete search history.

(56) References Cited

U.S. PATENT DOCUMENTS

| | | | | |
|---|---|---|---|---|
| 4,633,600 | A * | 1/1987 | Dassler et al. | 36/134 |
| 4,723,366 | A | 2/1988 | Hagger | |
| 5,027,532 | A | 7/1991 | MacNeill et al. | |
| 5,033,211 | A | 7/1991 | Latraverse et al. | |
| 5,036,606 | A | 8/1991 | Erich et al. | |
| D320,882 | S | 10/1991 | Collins | |
| 5,065,534 | A | 11/1991 | Collins | |
| D333,719 | S | 3/1993 | Latraverse et al. | |
| D343,558 | S | 1/1994 | Latraverse et al. | |
| 5,321,901 | A | 6/1994 | Kelly | |
| 5,386,651 | A | 2/1995 | Okamoto | |
| 5,426,873 | A | 6/1995 | Savoie | |
| 5,452,526 | A | 9/1995 | Collins | |
| D363,607 | S | 10/1995 | Collins et al. | |
| 5,524,367 | A | 6/1996 | Ferreira et al. | |
| D373,675 | S | 9/1996 | McMullin | |
| 5,572,807 | A | 11/1996 | Kelly et al. | |
| D378,013 | S | 2/1997 | McMullin | |
| 5,628,129 | A | 5/1997 | Kilgore et al. | |
| D380,076 | S | 6/1997 | McMullin | |
| D385,988 | S | 11/1997 | McMullin | |
| D387,548 | S | 12/1997 | McMullin | |
| D389,299 | S | 1/1998 | McMullin | |
| D392,451 | S | 3/1998 | Collins et al. | |

(Continued)

*Primary Examiner* — Ted Kavanaugh
(74) *Attorney, Agent, or Firm* — Greer, Burns & Crain, Ltd.

(57) ABSTRACT

A removable spike or cleat assembly for footwear, including a sole, wherein the assembly includes a spike or cleat constructed from an elastically deformable material and including one or more leg members and mounting apparatus adapted to engage with the sole, wherein the spike or cleat is adapted to engage with a projection located on the mounting apparatus, the engagement between the spike or cleat and the projection being achieved by rotating the spike or cleat relative to the projection and at least partially inserting the one or more leg members into one or more apertures located on the mounting apparatus, and wherein the spike or cleat is disengaged from the mounting apparatus by producing an elastic deformation of the one or more leg members.

14 Claims, 14 Drawing Sheets

U.S. PATENT DOCUMENTS

D393,787 S 4/1998 Savoie
D395,542 S 6/1998 Collins
5,761,833 A 6/1998 McMullin
5,794,367 A 8/1998 Carroll
D401,046 S 11/1998 McMullin
D404,192 S 1/1999 McMullin
5,875,572 A 3/1999 Redburn
D407,893 S 4/1999 McMullin
D408,122 S 4/1999 McMullin
D409,463 S 5/1999 McMullin
5,901,472 A 5/1999 Adam
5,946,828 A 9/1999 Jordan et al.
5,957,642 A 9/1999 Pratt
D415,340 S 10/1999 McMullin
5,960,568 A 10/1999 Bell et al.
5,974,700 A 11/1999 Kelly
5,987,784 A 11/1999 Bignell
5,996,260 A 12/1999 MacNeill
6,006,454 A 12/1999 Sitzler, Sr.
6,009,640 A 1/2000 Deacon et al.
6,023,860 A 2/2000 McMullin
6,041,526 A 3/2000 Collins
6,052,923 A 4/2000 McMullin
6,094,843 A 8/2000 Curley, Jr.
6,108,944 A 8/2000 Savoie
D434,289 S 11/2000 McMullin
D434,290 S 11/2000 McMullin
6,151,805 A 11/2000 Savoie
6,154,984 A 12/2000 Adam
6,167,641 B1 1/2001 McMullin
D439,396 S 3/2001 Savoie
D439,733 S 4/2001 Savoie
6,248,278 B1 6/2001 Kelly
6,272,774 B1 8/2001 Kelly
D448,547 S 10/2001 Savoie
D449,431 S 10/2001 Savoie
D449,921 S 11/2001 McMullin
D450,431 S 11/2001 Savoie
D450,432 S 11/2001 Savoie
D450,433 S 11/2001 Savoie
D450,434 S 11/2001 Savoie
D450,435 S 11/2001 Savoie
D450,436 S 11/2001 Savoie
D450,915 S 11/2001 McMullin
D451,265 S 12/2001 Savoie
D452,062 S 12/2001 Savoie
D452,063 S 12/2001 Savoie
D452,064 S 12/2001 Savoie
D452,065 S 12/2001 Savoie
6,327,797 B1 12/2001 Deacon et al.
6,332,281 B1 12/2001 Savoie
D454,248 S 3/2002 Savoie
6,354,021 B1 3/2002 Deacon et al.
D457,294 S 5/2002 Savoie
6,397,499 B1 6/2002 Savoie
6,451,242 B2 9/2002 Kelly
6,463,681 B1 10/2002 Savoie
D468,895 S 1/2003 Savoie
D469,245 S 1/2003 Savoie
D473,699 S 4/2003 Savoie
6,601,042 B1 7/2003 Lyden
6,631,571 B2 10/2003 McMullin
D493,276 S 7/2004 McMullin
D495,122 S 8/2004 McMullin
6,810,608 B2 11/2004 Kelly
6,823,613 B2 11/2004 Kelly et al.
6,826,854 B2 12/2004 Ijiri
6,834,445 B2 12/2004 McMullin
6,834,446 B2 12/2004 McMullin
6,904,707 B2 6/2005 McMullin
D509,050 S 9/2005 Savoie
D510,179 S 10/2005 McMullin
D513,359 S 1/2006 McMullin
6,983,556 B2 1/2006 McMullin
D515,294 S 2/2006 McMullin
D515,295 S 2/2006 McMullin
D515,296 S 2/2006 McMullin
D515,794 S 2/2006 Spencer
D517,292 S 3/2006 McMullin
7,007,413 B2 3/2006 McMullin
7,040,043 B2 5/2006 McMullin
7,047,674 B1 5/2006 Garvie
D522,220 S 6/2006 McMullin
7,086,182 B2 8/2006 Deacon et al.
7,107,708 B2 9/2006 Kelly et al.
7,134,226 B2 11/2006 Robinson, Jr. et al.
7,137,213 B2 11/2006 Kelly et al.
D553,336 S 10/2007 McMullin
RE40,047 E 2/2008 Carroll
7,398,610 B2 7/2008 McMullin
D592,391 S 5/2009 McMullin
7,559,160 B2 7/2009 Kelly
7,647,711 B2 1/2010 McMullin
7,726,043 B2 6/2010 Shuttleworth et al.
7,774,958 B2 8/2010 Carruthers
2002/0152643 A1 10/2002 Kim
2004/0031171 A1 2/2004 Chen
2005/0000119 A1 1/2005 McMullin
2005/0155256 A1 7/2005 Santos et al.
2009/0293317 A1 12/2009 Krikorian
2009/0307933 A1 12/2009 Leach

* cited by examiner

Figure 10
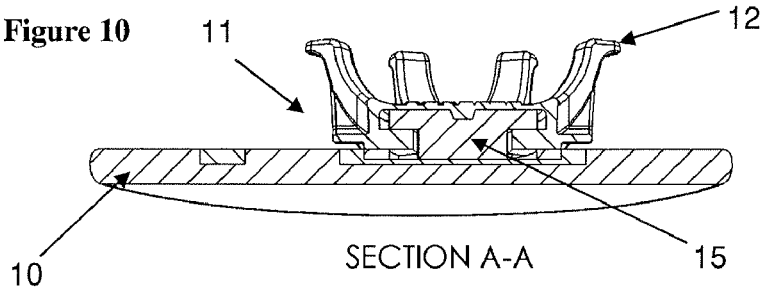
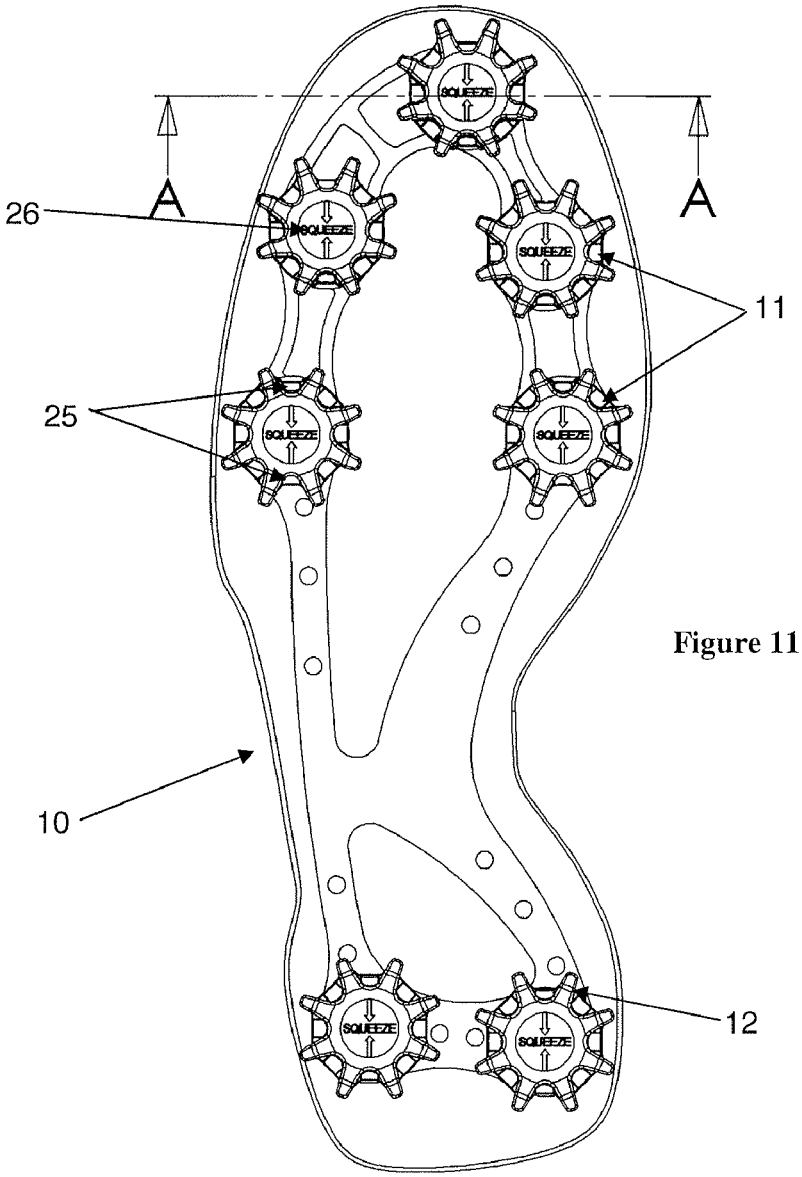
Figure 11

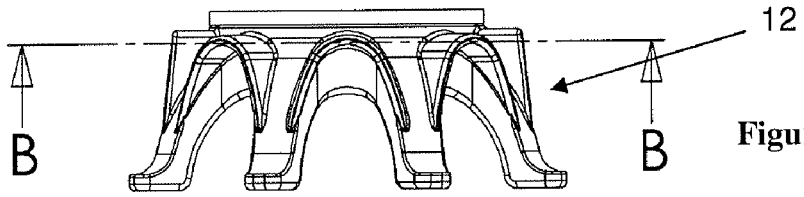
Figure 12
Figure 13
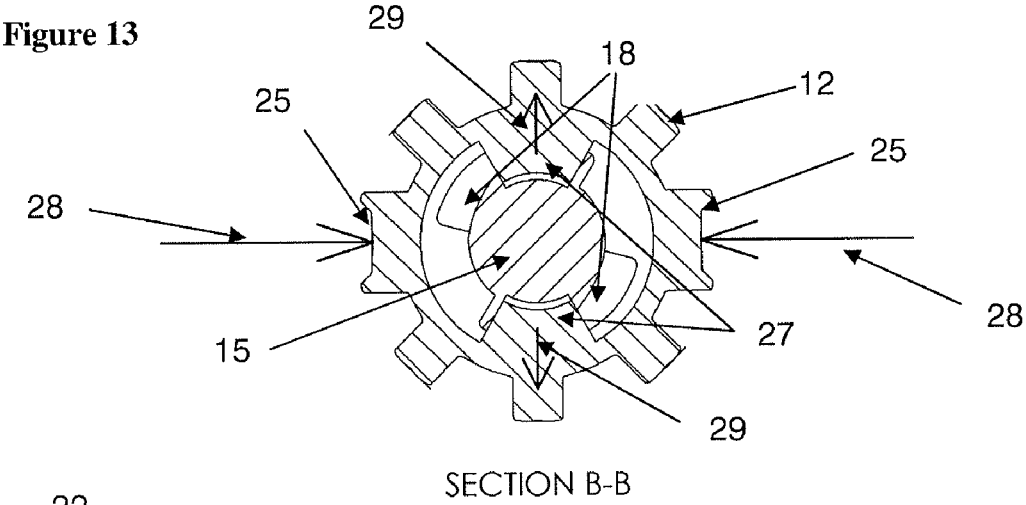
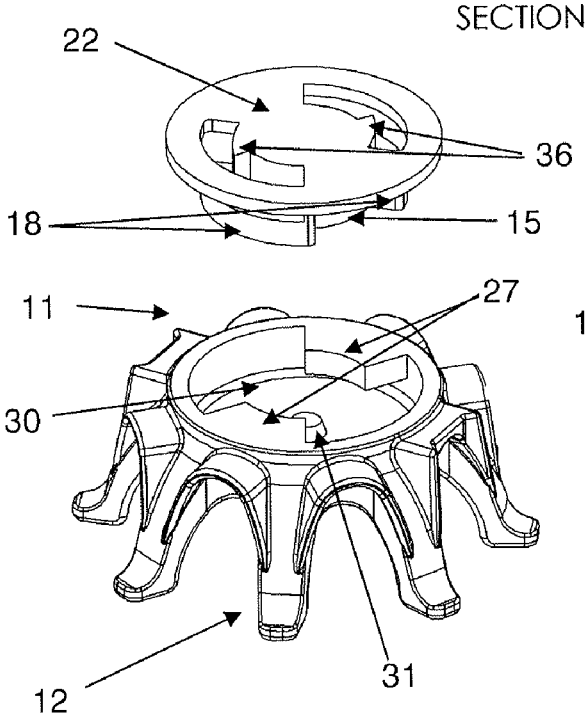
Figure 14
Figure 15
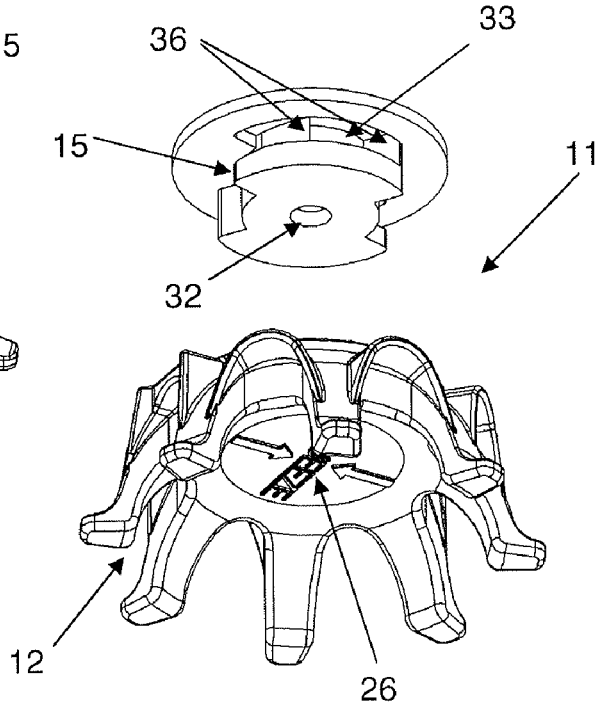

Figure 16
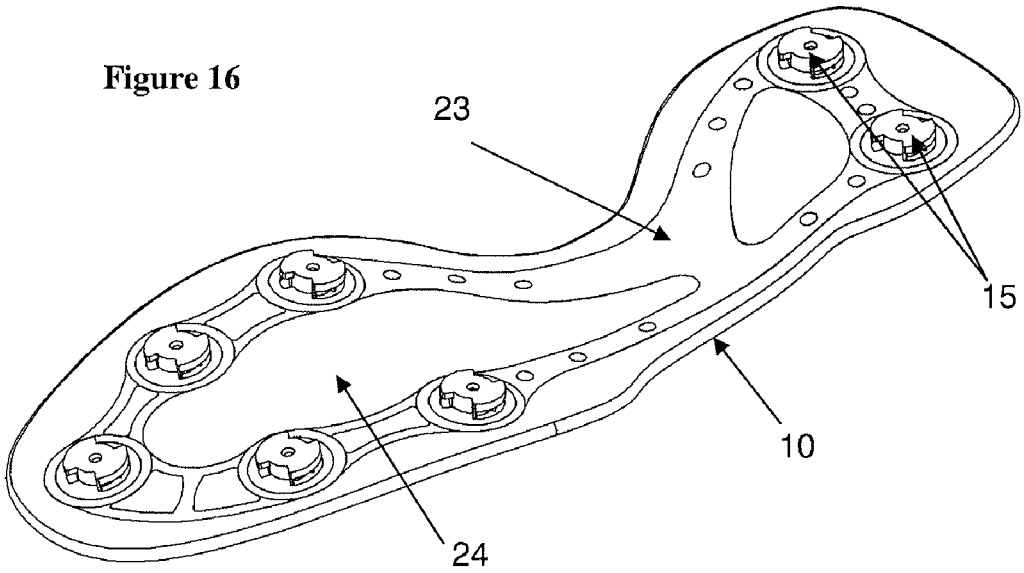
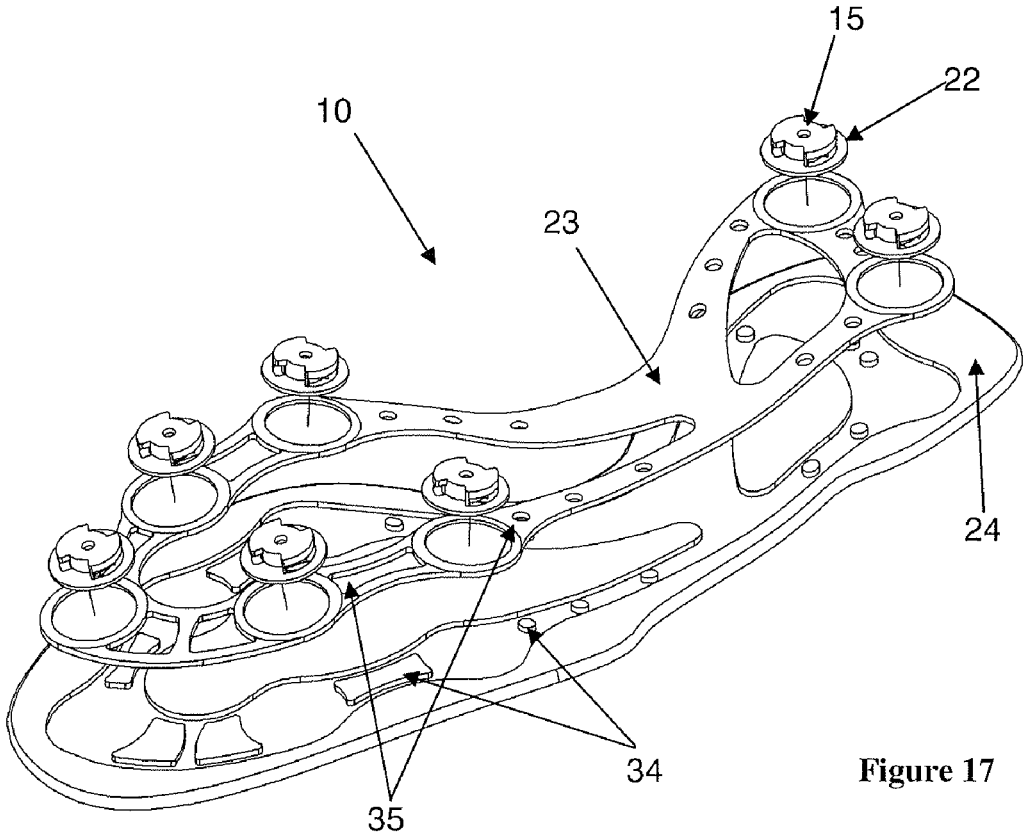
Figure 17

REMOVABLE SPIKE FOR FOOTWEAR

RELATED APPLICATIONS

This application is a Continuation-in-Part of PCT/AU2007/001840 filed Nov. 28, 2007.

FIELD OF THE INVENTION

The present invention relates to a removable spike for footwear, particularly for athletic or sports footwear.

BACKGROUND ART

Many types of footwear, and particularly athletic footwear, are fitted with spikes, cleats or studs in order that the wearer may maintain their footing, even when the ground is wet or slippery. This type of footwear is commonly used by golfers, cricketers, sprinters and players of all football codes, amongst others.

Traditionally, the spikes, cleats or studs (hereinafter referred to collectively as "spikes") have been of the type that comprise a screw thread for screwing the spike into a threaded bore in the sole of a shoe. In order to accommodate the threaded bore, the sole of the shoe must be quite thick. In turn, a thick sole makes the shoe heavy, less flexible, and therefore less comfortable for the wearer.

There is also an advantage to provide a spike that can be replaced, and especially a spike that can be replaced in a relatively easy manner.

It will be clearly understood that, if a prior art publication is referred to herein, this reference does not constitute an admission that the publication forms part of the common general knowledge in the art in Australia or in any other country.

SUMMARY

It is an object of the present invention to provide a removable spike for footwear which may overcome at least some of the abovementioned disadvantages, or provide a useful or commercial choice.

It is a further object of the present invention to provide a removable spike or cleat assembly for footwear which may overcome at least some of the abovementioned disadvantages, or provide a useful or commercial choice.

In one form, the invention resides in a removable spike assembly for footwear, said footwear including a sole, wherein said assembly comprises a spike and a mounting means adapted to engage with the sole, said assembly further comprising a hub adapted to connect to the spike and engage with a projection located on said mounting means.

In another form, the invention resides in a removable spike assembly for footwear, the spike assembly comprising a spike, and a mounting means, the mounting means comprising a base portion adapted for attachment to the footwear and particularly to the sole, and a projection extending from the base portion, and a hub adapted to be removably connected to the projection, the spike adapted to be held by the projection and the hub.

In yet another form, the invention resides in a removable spike assembly for footwear comprising a mounting means, said mounting means comprising a base portion and a projection, a spike and a hub.

In yet another form, the invention resides in a removable spike assembly for footwear comprising a spike, a hub and mounting means, said mounting means formed integrally with a sole of a shoe and comprising a base portion and a projection.

The base portion of the integrally-formed mounting means may be formed level with the sole of the shoe, slightly recessed in the sole of the shoe, or slightly proud of the sole of the shoe.

It is preferred, however, that the base portion of the mounting means is formed level with the sole of the shoe.

In this manner, the spike can be releasably held in place by being "sandwiched" between the hub and the projection. Typically, the hub can be quite readily removed from the post thereby allowing the spike to be easily removed and replaced/cleaned etc.

An advantage of the particular arrangement is that the fastening mechanism that fastens the spike to the footwear is such that there is no need to have a thick sole to accommodate a threaded bore etc. Therefore, the golf shoe (or other footwear article) can have a relatively thin sole.

Preferably, the mounting means is connected to the sole of the footwear.

In another embodiment of the invention, the sole of the shoe may be provided with at least one recess designed to accommodate at least one mounting means within the recess.

Preferably, the projection of the mounting means comprises a post. The mounting means may be substantially cylindrical and may be anchored or otherwise attached to or into or relative to the footwear and particularly relative to the sole. It is envisaged that the post will have a first portion which may form part of the sole, and a second portion which may extend upwardly and provide an attachment point for the hub. The second portion may be cylindrical and may have a height of between 2-10 mm and a diameter of between 2-10 mm. It is envisaged that the second portion need not be cylindrical and may comprise a rectangular cross-section and the like. The post may be provided with engagement means or something similar to assist in engagement (typically releasably engagement) of the hub relative to the post. The engagement means may comprise land sections or "ears". The mounting means may be provided with more than one post.

The spike assembly may be made from any suitable material. However, it is preferred that the spike assembly be constructed from lightweight materials such as plastic, fiberglass or a light metal such as aluminium. By making use of lightweight materials, the spike assembly does not add a great deal of weight to the shoe, making the shoe more comfortable for the wearer.

Preferably, the post is provided with at least one land portion. Preferably, the land portion is provided adjacent to the top of the post at the outermost part of the mounting means, furthest from the sole of the shoe.

Preferably, the hub is provided with at least one projection that engages with the land portion provided on the post.

Preferably, the at least one projection is located on an underside of the hub.

Preferably, the hub and post engage by connecting all components of the spike assembly and then rotating the hub to cause the at least one projection on the hub to engage with the at least one land portion on the post.

Preferably, the hub is rotated no more than 90° in order to achieve a fixed engagement with the post, although it may be that the hub is rotated more than 90° in order to achieve engagement with the post. However, there is no continual rotation of the hub in the manner of a threaded screw.

Preferably, the hub is provided with means to assist the user in causing the rotation of the hub. The means may comprise any suitable means for permitting the rotation of the hub, such as, for instance, a channel to allow said hub to be rotated using a screwdriver, coin, fingernail or the like, or one or more holes adapted to receive a tool, the tool being used to cause rotation of the hub. By providing means to allow the user to rotate the hub, the spike assembly may be quickly and easily attached and removed for cleaning, maintenance or replacement as required.

Preferably, said means is provided on the outermost surface of the hub.

In a preferred embodiment of the invention, the hub comprises two projections.

In another preferred embodiment of the invention, the post comprises two Sand portions. These land portions are preferably placed opposite one another on the post. When the hub is engaged with the post and is rotated, the projections on the hub slide under the land portions of the post, thus locking the spike assembly in place.

Preferably, the base of the mounting means comprises a plate, said plate being rigidly held in place on the sole of the shoe or within a recess in the sole of the shoe. More preferably, the plate is in the form of a flat disc. Alternatively, the post may be attached directly to the sole of the shoe. In a further embodiment of the invention, the mounting means may be integrally moulded with the sole of the shoe.

The location of the mounting means on the sole of the shoe is not critical. However, the mounting means will typically be placed in positions on the sole that provide the user with the best comfort and grip.

The sole of the shoe may be manufactured using any suitable process. However, it is preferred that the sole of the shoe is moulded from plastic, rubber or other like substance. In a preferred embodiment of the invention, the sole of the shoe is formed in two parts. The first part, or skeleton, may be formed of a hard material, such as, but not limited to, polyurethane, while the second part may be formed of a softer material. Typically, the skeleton will be at least partially surrounded by the second part. In use, the skeleton may comprise one or more of the mounting means integrally formed within it.

In yet another preferred embodiment of the present invention, the spike comprises at least one projection for engaging with the ground when the shoe is in use.

Preferably, the spike comprises an annular ring, with said at least one projection located on said annular ring.

Preferably said hub fixedly engages with said spike by pushing said hub into said annular ring.

Preferably said hub is held in place in said annular ring by a snap-lock connection.

Preferably, when said hub and said annular ring are engaged by a snap-lock connection, said hub may still rotate independently of said annular ring.

Preferably, said spike further comprises at least one key for engagement with at least one keyhole. Preferably the keyholes are located on the base portion of the mounting means. More preferably, the spike assembly comprises six keys and six keyholes. When the keys and keyholes are connected, no lateral movement of the spike is possible. Thus, when the spike assembly is in use, it is not possible for the hub to loosen as no lateral movement of the assembly is possible.

In another form, the invention resides in a removable spike assembly for footwear, said footwear including a sole, wherein said assembly comprises a spike constructed from an elastically deformable material and a mounting means adapted to engage with the sole, wherein the spike is adapted to engage with a projection located on said mounting means, the engagement between the spike and the projection being achieved by rotating the spike relative to the projection.

The mounting means may comprise any suitable form. However, it is preferred that the mounting means comprises a base portion adapted for attachment to the footwear, and particularly the sole of the footwear, and a projection extending from the base portion. The base portion of the mounting means may be formed separately and adapted for engagement with the sole of the shoe, or may be formed integrally with the sole of the shoe. While the projection may be of any suitable configuration, it is preferred that the projection comprises a post.

The spike may be adapted to engage with the post located on the mounting means using any suitable method. However, it is preferred that the spike comprises one or more projections. In a most preferred embodiment of the invention, the spike comprises two projections.

In another embodiment of the invention, the post comprises one or more land portions.

Preferably, the post comprises two land portions. These land portions are preferably placed opposite one another on the post. When the spike is engaged with the post and is rotated, the projections on the spike slide under the land portions of the post, thus locking the spike assembly in place.

The spike may be constructed from any suitable material, such as plastic, rubber, metal and the like. However, it is preferred that the spike is constructed from a material that is elastically deformable under pressure. In a most preferred embodiment of the invention, the spike may be constructed so as to elastically deform under manual pressure applied by the user, or by pressure applied by a tool, such as a pair of pliers. In order to make the application of manual pressure to the spike easier for the user, the spike may further comprise one or more pressure points adapted for a user's lingers or a tool. Preferably, the spike comprises two pressure points. More preferably, the two pressure points are located opposite one another. Still more preferably, the pressure points are located at approximately a 90° angle to the location of the projections on the spike.

By fabricating the spike from an elastically deformable material, the spike may be deformed during attachment to or removal from the post. The ability to manually deform the spike makes its removal or attachment simple, fast and does not require the wearer to remove the shoe to clean or replace a spike.

In an alternative embodiment of the invention, the post may be provided with one or more ridges. The one or more ridges may be adapted to engage with the projections on the spike when the spike is connected to the post. Preferably, the one or more ridges may be adapted to prevent the rotation of the spike once the spike is connected to the post. In a preferred embodiment of the invention, the spike may only be removed from the post by elastically deforming the spike so that it may be rotated in its deformed state past the one or more ridges on the post. It is preferred that the one or more ridges are constructed from a more rigid material than the spike.

In another aspect of the present invention there is provided a shoe comprising at least one spike assembly as hereinbefore described.

In a further aspect, the present invention provides a removable spike or cleat assembly for footwear, said footwear including a sole, wherein said assembly comprises a spike or cleat constructed from an elastically deformable material and including one or more leg members and mounting means adapted to engage with the sole, wherein the spike or cleat is adapted to engage with a projection located on said mounting means, the engagement between the spike or cleat and the projection being achieved by rotating the spike or cleat relative to the projection and at feast partially inserting the one or more leg members into one or more apertures located on the mounting means, and wherein the spike or cleat is disengaged from the mounting means by producing an elastic deformation of the one or more leg members.

The mounting means may comprise any suitable form. However, it is preferred that the mounting means comprises a base portion adapted for attachment to the footwear, and particularly the sole of the footwear, and a projection extending from the base portion. The base portion of the mounting means may be formed separately and adapted for engagement with the sole of the shoe, or may be formed integrally with the sole of the shoe. While the projection may be of any suitable configuration, it is preferred that the projection comprises a post.

In some embodiments of the invention, the mounting means may be adapted for connection to the sole in such a way that the base portion sits slightly proud of the surface of the sole. Alternatively, the sole of the shoe may be provided with one or more recesses into which the base portion may be adapted to be retained using any suitable technique. In this embodiment of the invention, the base portion may sit flush with the surface of the sole or may be slightly recessed into the surface of the sole.

The spike or cleat may be adapted to engage with the post located on the mounting means using any suitable method. However, it is preferred that the spike comprises one or more projections. In a most preferred embodiment of the invention, the spike comprises three projections.

In another embodiment of the invention, the post comprises one or more land portions.

Preferably, the post comprises three land portions. These land portions are preferably placed opposite one another on the post. When the spike or cleat is engaged with the post and is rotated, the projections on the spike or cleat may slide under the land portions of the post, thus locking the spike or cleat in place.

In a further embodiment of the invention, the post may be provided with alignment means. Any suitable alignment means may be provided, although it is preferred that the alignment means are adapted to engage with complementary alignment means provided on the spike or cleat. The alignment means may comprise, for instance, a projection and recess, pair of tabs, or the like adapted to assist a user in correctly aligning the spike or cleat and the post when engaging the spike or cleat with the post.

The spike or cleat may be constructed from any suitable material, such as plastic, rubber, metal and the like. However, it is preferred that the spike or cleat is constructed from a material that is elastically deformable under pressure. In a most preferred embodiment of the invention, the spike may be constructed so as to elastically deform under manual pressure applied by the user, or by pressure applied by a tool, such as a pair of pliers. In a preferred embodiment of the invention, the spike or cleat may be in a non-elastically deformed state when engaged with the mounting means. In some embodiments of the invention, the entire spike or cleat may be fabricated from an elastically deformable material, while in other embodiments of the invention, only a portion of the spike or cleat (for instance, the one or more leg members) may be fabricated from an elastically deformable material.

As previously described, the spike or cleat includes one or more leg members. The leg members may be of any suitable form, although in a preferred embodiment of the invention, the one or more leg members comprise an elongated member. Preferably, a first end of the leg member is adapted for engagement with the ground when the spike or cleat is in use. In some embodiments of the invention, the leg member may be provided with a ground-engaging portion. Any suitable ground-engaging portion may be used, such as, but not limited to, a foot. The ground-engaging portion of the leg member may be adapted to provide a user with extra stability, extra grip, or a combination of the two.

In some embodiments of the present invention, a second end of the leg member may be adapted for at least partial insertion into one or more apertures located on the mounting means. Preferably, the one or more apertures are located in the base portion of the mounting means. In this embodiment of the invention, the apertures may extend fully through the base portion, or may extend only partially through the base portion. In an alternative embodiment of the present invention, the one or more apertures may be located in the sole of the shoe. In a preferred embodiment of the invention, the spike or cleat is provided with a plurality of leg members, each of said plurality of leg members adapted to engage with an aperture. The engagement between the one or more leg members and the one or more apertures prevents lateral movement of the spike or cleat.

The engagement between the leg member and the aperture may be achieved using any suitable technique. For instance, the aperture, the leg member or both may be provided with retention means (such as labs, lands, recesses, projections, sticky, tacky or adhesive portions, Velcro or the like, or any combination thereof) such that when the leg member is inserted into the aperture, the retention means align and retain the leg member within the aperture.

Alternatively, the spike or cleat may be fabricated in such a way that the leg member has a natural bias, in this way, the natural bias of the leg member may result in the leg member gripping the edge of the aperture with sufficient force to retain the spike or cleat in place on the mounting means.

In order to make the application of manual pressure to the spike or cleat easier for the user, the spike or cleat may further comprise one or more pressure points adapted for a user's fingers or a tool. Specifically, the one or more pressure points may be located on the leg members. Preferably, the one or more pressure points may be located adjacent the ground-engaging end of each of the leg members.

Preferably, the spike or cleat comprises three leg members. Still more preferably, the three leg members are arranged equidistantly from one another on the spike or cleat. By spacing the three leg members equidistantly, the user may be provided with an evenly balanced spike or cleat. In addition, disengagement of the spike or cleat from the mounting means may be made easier by spacing the leg members equidistantly from one another.

By fabricating the spike or cleat from an elastically deformable material, the spike or cleat may be deformed during attachment to or removal from the post. The ability to manually deform the spike or cleat makes its removal or attachment simple, fast and does not require the wearer to remove the shoe to clean or replace a spike or cleat. Specifically, the one or more leg members of the spike or cleat may be deformed through the application of pressure. This application of pressure adjacent the ground-engaging end of the leg member may cause the leg member to tilt to an angle between the vertical and horizontal, thereby either disengaging the retaining means or overcoming the natural bias of the leg member. When the leg member is tilted at this angle, the spike or cleat may then be rotated out of engagement with the mounting means, or simply lifted clear of the mounting means, or a combination of the two.

The location of the mounting means on the sole of the shoe is not critical. However, the mounting means will typically be placed in positions on the sole that provide the user with the best comfort and grip. Similarly, the number of mounting means (and therefore the number of removable spike or cleat assemblies) is not critical, although a skilled addressee will understand that the number of mounting means will be determined by a desire to provide the user with the best comfort and grip. However, a skilled addressee will also understand that the number of mounting means may be limited by the size of the shoe (i.e. larger shoes may be provided with more mounting means), it is envisaged, however, that the size of the removable spike or cleat assemblies could be varied depending on the wearer (for instance, relatively large assemblies in men's shoes, and smaller assemblies in women's and children's shoes).

The sole of the shoe may be manufactured using any suitable process. However, it is preferred that the sole of the shoe is moulded from plastic, rubber or other like substance. In a preferred embodiment of the invention, the sole of the shoe is formed in two parts. The first part, or skeleton, may be formed of a hard material, such as, but not limited to, polyurethane, while the second part may be formed of a softer material. Typically, the skeleton will be at least partially surrounded by the second part. In use, the skeleton may comprise one or more of the mounting means integrally formed within it.

In yet another preferred embodiment of the present invention, the spike or cleat comprises at least one further projection for engaging with the ground when the shoe is in use.

In some embodiments of the invention, the spike or cleat may be provided with indicia adapted to indicate to a user the correct manner to disengage the spike or cleat from the mounting means. Any suitable indicia may be used, such as, but not limited to, one or more symbols (such as arrows), letters, numbers, pictures or the like, or any combination thereof. Preferably, the indicia indicate the direction in which the one or more leg members may be elastically deformed in order to disengage the spike or cleat from the mounting means.

In a still further aspect of the present invention there is provided a shoe comprising at least one removable spike or cleat assembly as hereinbefore described.

BRIEF DESCRIPTION OF THE DRAWINGS

An embodiment of the invention will be described with reference to the following drawings in which:

FIG. 10 illustrates a cross-sectional view of a spike assembly and shoe sole in accordance with another embodiment of the invention;

FIG. 11 illustrates a top plan view of a shoe sole in accordance with another embodiment of the invention;

FIG. 12 illustrates a side elevation of a spike in accordance with another embodiment of the invention;

FIG. 13 illustrates a cross-sectional view of a spike assembly in accordance with another embodiment of the invention;

FIG. 14 illustrates an exploded view of a spike assembly seen from above in accordance with an embodiment of the invention;

FIG. 15 illustrates an exploded view of a spike assembly seen from below in accordance with an embodiment of the invention;

FIG. 16 illustrates a perspective view of the sole of a shoe in accordance with another embodiment of the invention;

FIG. 17 illustrates an exploded view of a shoe sole and spike assembly in accordance with another embodiment of the invention.

DETAILED DESCRIPTION

Figure 1A:
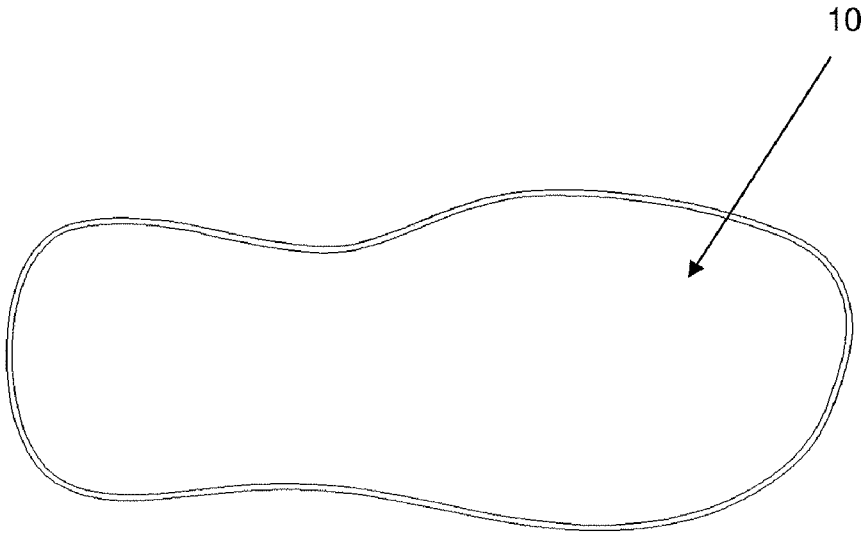
FIG. 1*a* illustrates a top plan view of a shoe sole in accordance with an embodiment of the invention.

It will be appreciated that the drawings have been provided for the purposes of illustrating preferred embodiments of the present invention and that the invention should not be considered to be limited solely to the features as shown in the drawings.

Figure 1B:
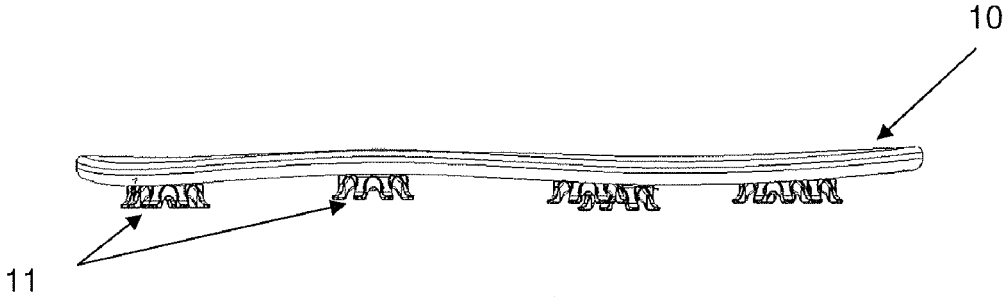
FIG. 1*b* illustrates a side elevation of a shoe sole in accordance with an embodiment of the invention.
Figure 1C:
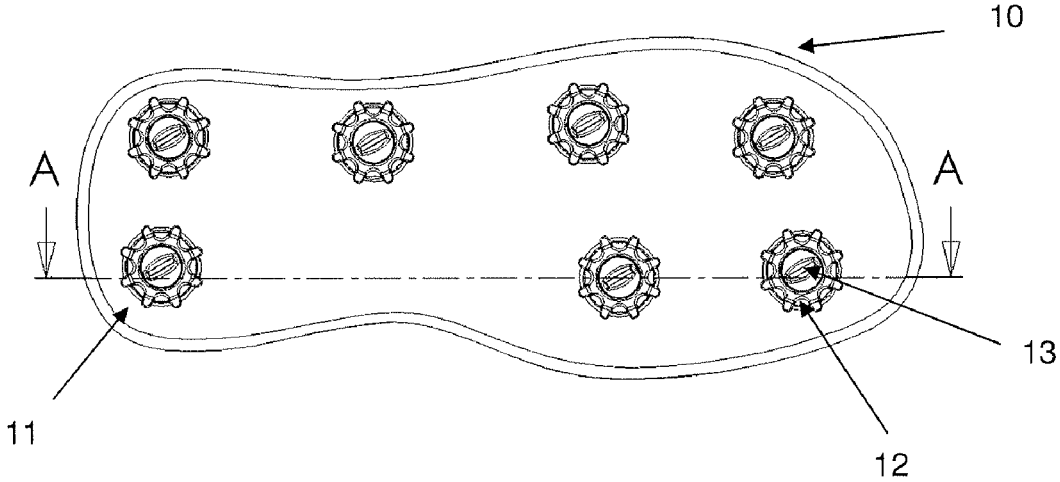
FIG. 1*c* illustrates a bottom plan view of a shoe sole in accordance with an embodiment of the invention.

Referring to FIG. 1*a* of the drawings there is shown a shoe sole 10. FIG. 1*b* illustrates a side elevation of the shoe sole 10 including a number of spike assemblies 11 according to the present invention. FIG. 1*c* illustrates the bottom of the shoe sole 10. The spike assemblies 11 comprise a spike 12 and a rotatable hub 13 engagable with the spike 12.

Figure 2:
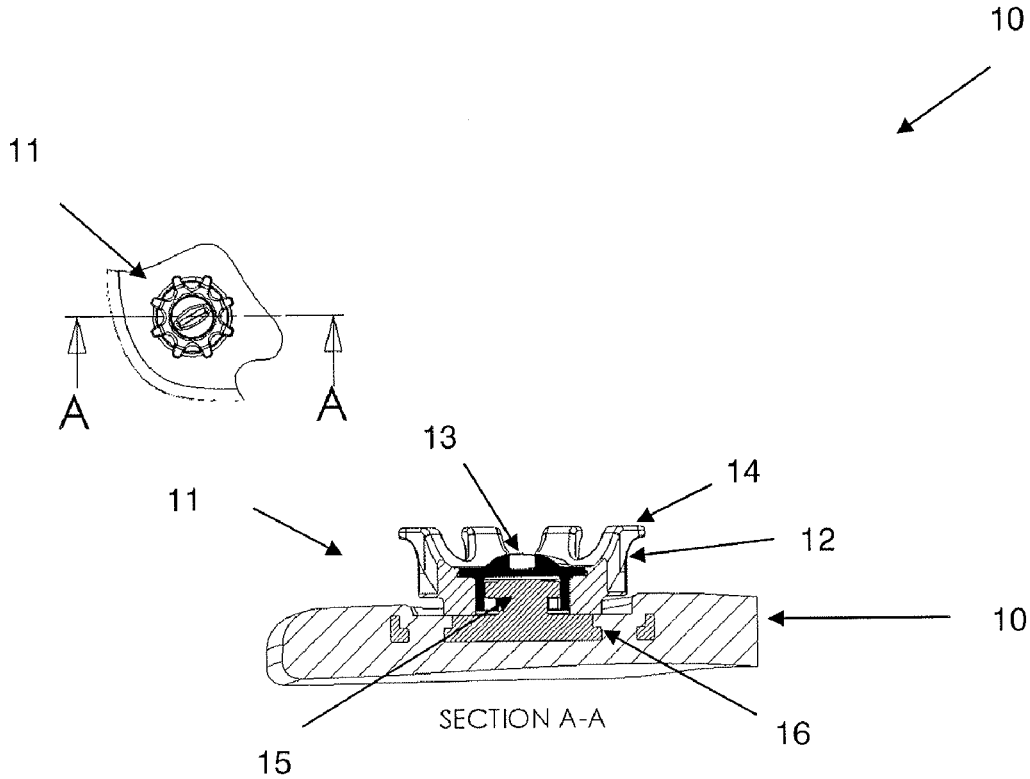
FIG. 2 illustrates a cross-sectional view of an installed spike assembly in accordance with an embodiment of the invention.

In FIG. 2 there is shown a cross-sectional view of the spike assembly 11 when fully assembled. The hub 13 engages with the spike 12 in a snap-lock configuration. In the embodiment of the invention illustrated, the spike 12 is provided with a plurality of projections 14 which, when in use, provide the user with improved grip and stability, particularly on a wet or slippery surface. A post 15 is provided in a recess 16 in the sole 10 of the shoe.

Figure 3:
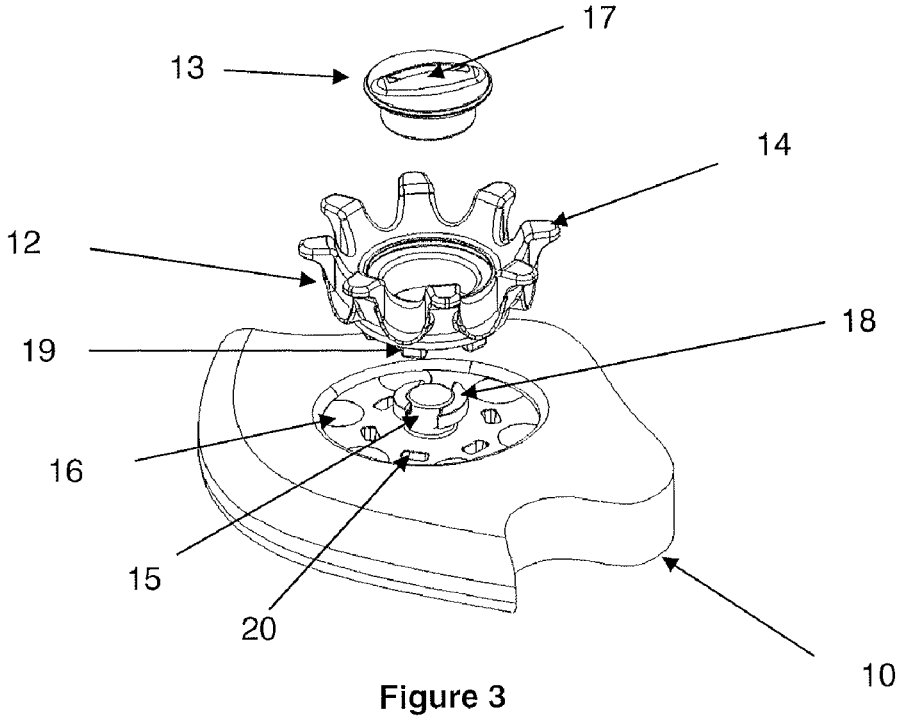
FIG. 3 illustrates an exploded view of a spike assembly and shoe sole seen from above in accordance with an embodiment of the invention.

In the embodiment of the invention illustrated in FIG. 3, it may be seen that the spike 12 comprises an annular ring provided with a plurality of projections 14. The hub 13 engages the spike 12 by being pressed into the centre of the annular ring. Once engaged, the hub 13 may still be rotated independently of the spike 12. A channel 17 is provided in the outermost surface of the hub 13, allowing the hub 13 to be rotated within the spike 12 using a screwdriver, coin, or the like. The maximum rotation of the hub 13 required to secure the spike assembly 11 in place is 90°. The post 15 comprises two land sections 18 which engage with projections on the hub 13.

On the opposite side of the annular ring of the spike 12 to the projections 14, there is provided a plurality of keys 19 which slot into corresponding keyholes 20 located inside the recess 16. By slotting the keys 19 into the keyholes 20, no lateral movement of the spike 12 is permitted. The advantage of this is that the spike assembly may be simply attached and detached from the shoe for replacement or cleaning, but will not come loose during periods of use.

Figure 4:
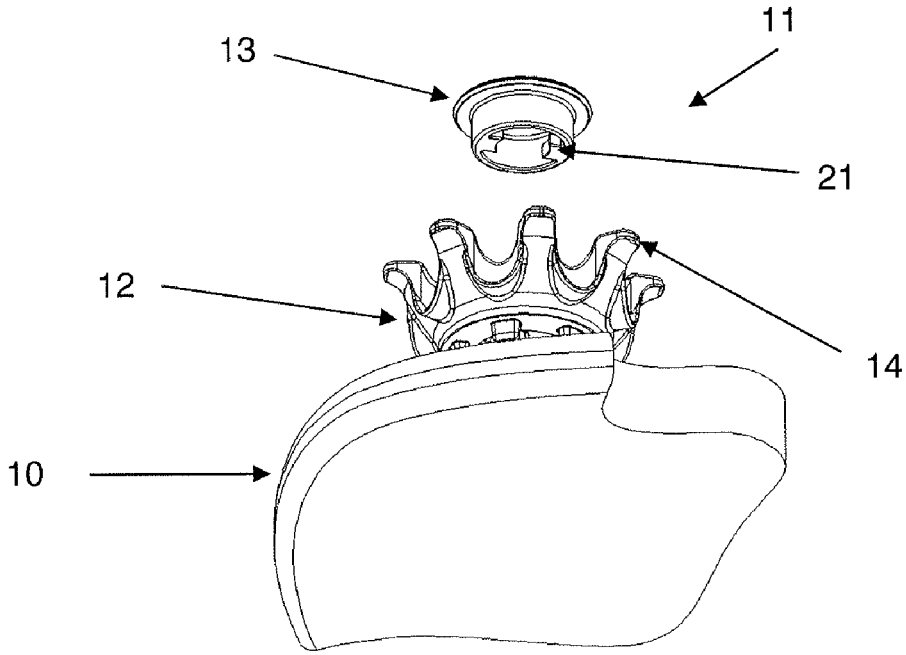
FIG. 4 illustrates an exploded view of a spike assembly and shoe sole seen from below in accordance with an embodiment of the invention.

The embodiment of the invention illustrated in FIG. 4 shows two projections 21 located on the underside of the hub 13. When connecting the spike assembly 11, the rotation of the hub 13 causes these two projections 21 to slide under the lands (not shown) located on the post (not shown), thereby locking the spike assembly 11 in place.

Figure 5:
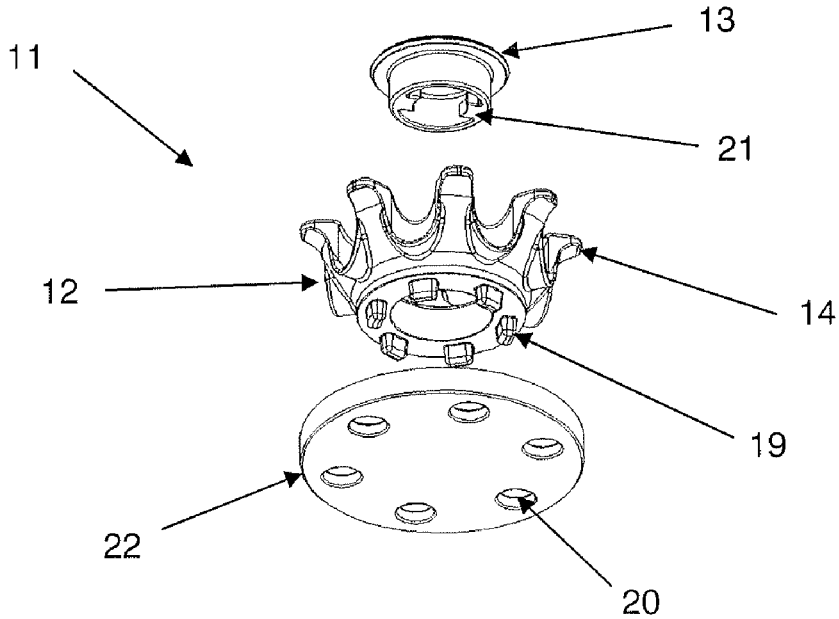
FIG. 5 illustrates an exploded view of a spike assembly seen from below in accordance with an embodiment of the invention.

FIG. 5 illustrates an exploded view of an embodiment of the invention using a plate 22. The plate 22 may be rigidly fixed within the recess (not shown). The plate 22 comprises a plurality of keyholes 20 designed to engage with a plurality of keys 19 located on the annular ring of the spike 12. Once the plate 22 and the spike 12 are correctly aligned, the hub 13 may be pressed into place in the centre of the annular ring of the spike 12. Once pressed into place, the hub 13 may be rotated.

Figure 6:
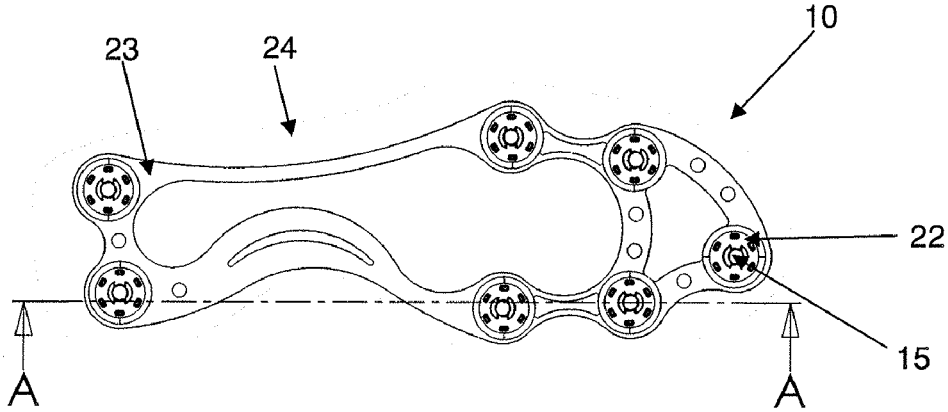
FIG. 6 illustrates a top plan view of a shoe sole in accordance with another embodiment of the invention.

FIG. 6 illustrates an alternative embodiment of the present invention. The sole 10 of the shoe is of a two part construction, comprising a hard skeleton 23 and a softer material 24 moulded around the skeleton 23. In this embodiment of the invention, the mounting means comprises a plate 22 and post 15 integrally formed with the skeleton 23.

Figure 7:
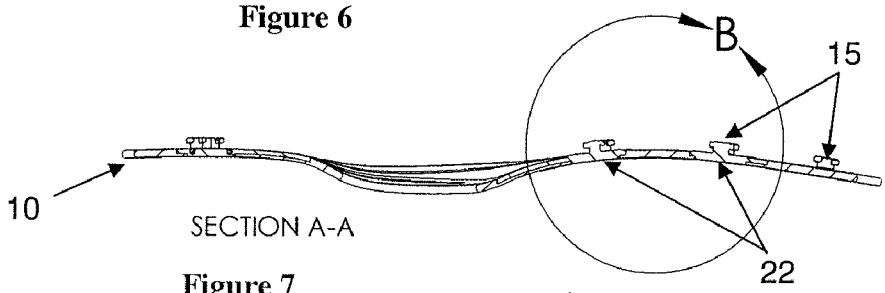
FIG. 7 illustrates a side elevation of a shoe sole in accordance with another embodiment of the invention.
Figure 8:
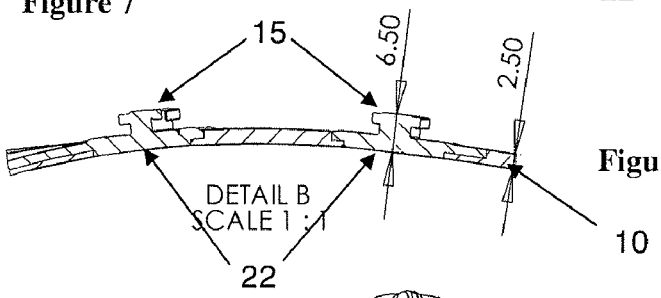
FIG. 8 illustrates a side elevation of a shoe sole in accordance with another embodiment of the invention.

FIG. 7 shows a side elevation of this alternative embodiment of the invention in which it may be seen that the plates 22 are formed integrally with the sole 10 of the shoe, and sit level with the sole 10 of the shoe, with posts 15 extending outwardly from the sole 10 of the shoe. FIG. 8 illustrates a more detailed view of the plates 22 and posts 15 integrally formed with the shoe sole 10. While in the embodiment illustrated, the plates 22 sit level with the shoe sole 10, in alternative embodiments of the invention the plates 22 may be slightly recessed within the shoe sole 10 or may be located slightly proud of the surface of the shoe sole 10.

Figure 9:
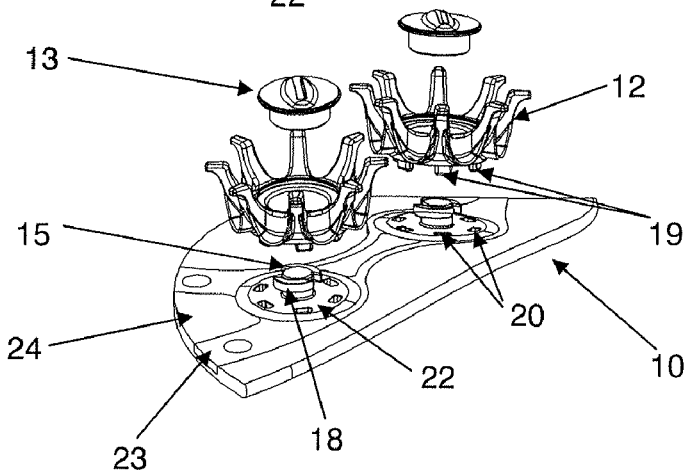
FIG. 9 illustrates an exploded view of a spike assembly and shoe sole seen from above in accordance with another embodiment of the invention.

In FIG. 9, a portion of the shoe sole 10 of the alternative embodiment of the invention is shown. The skeleton 23 is largely surrounded during the manufacturing process by the softer material 24. The mounting means, comprising a plate 22 and a post 15, are formed integrally with the skeleton 23, The plate 22 comprises a series of keyholes 20 which engage with corresponding keys 19 located on the spike 12. A hub 13 is pressed into the annular ring of the spike 12 and is rotated so that projections (not shown) on the hub 13 engage with a pair of land section 18 on the post 15. Thus, the hub is prevented from coming loose during periods of use of the shoe.

FIG. 10 illustrates a cross-sectional view of a spike assembly 11 and shoe sole 10 according to one embodiment of the invention. In this embodiment, the spike assembly 11 comprises a spike 12 and a post 15 to which the spike 12 may be directly attached.

In FIG. 11 there is illustrated the sole 10 of a shoe comprising a number of spike assemblies 11 according to an embodiment of the present invention. Each spike assembly 11 comprises a spike 12 connected directly to a post (not shown). The spike 12 may be provided with a pair of pressure points 25. Applying pressure to the pressure points 25 elastically deforms the spike 12 allowing for its removal from the post (not shown). The spike 12 may further be provided with instructions 26 for instructing the user as to how the spike 12 may be removed. The instructions 26 may be moulded with the spike 12 or may be added after forming the spike 12 by painting, or applied as a sticker and so on.

FIG. 12 illustrates a side elevation of the spike 12 according to an embodiment of the present invention. In FIG. 13, the spike 12 according to an embodiment of the present invention is shown in cross-section when connected to a post 15 and viewed from below.

When the spike 12 is attached to the post 15, the spike 12 is rotated so that a pair of projections 27 slides underneath a corresponding pair of lands 18 on the post 15. Thus, the spike 12 may be held in place. To remove the spike 12 from the post 15, pressure may be applied to a pair of pressure points 25 in the direction indicated by the pair of arrows 28. As the spike 12 is constructed from an elastically deformable material, the application of pressure will deform the spike 12 in the direction indicated by a second pair of arrows 29. As the spike 12 deforms, the projections 27 will move out from underneath the lands 18, thus allowing the spike 12 to be removed from the post 15 through the rotation of the spike 12. The spike 12 may also be attached to the post 15 in the same manner.

FIG. 14 illustrates an exploded view of a spike assembly 11 according to an embodiment of the present invention when viewed from above. In this embodiment of the invention the post 15 is attached to a plate 22, which may be formed separately from, or integrally with, the sole of a shoe (not shown). The pair of projections 27 on the spike 12 slide underneath the pair of lands 18 on the post 15 in order to hold the spike 12 in place. The spike 12 may be provided with a recess 30 into which the post 15 fits. When the spike 12 is attached to the post 15 the point at which the spike 12 and the post 15 connect may be entirely contained within a sealed chamber whose boundaries are defined by the recess 30 and the plate 22. Housing this connection point between the spike 12 and the post 15 in a sealed chamber prevents dirt, mud, grass or other debris from clogging the connection between the spike 12 and the post 15, thereby making the spike 12 much easier to remove or replace. The recess 30 may be provided with a protrusion 31 that engages with a corresponding hole (not shown) on the post 15 to ensure the correct alignment of post 15 and spike 12. In general, existing removable spike assemblies do not seek to prevent mud, grass and other debris from clogging their connection mechanisms. Thus, over time, debris will build up on the surface of the spike, clogging the spike removal means and making prior art spikes extremely difficult to remove and replace.

The post 15 of the embodiment illustrated in FIG. 14 may further be provided with a series of ridges 36. During connection of the spike 12 to the post 15 the spike 12 is brought into engagement with the post 15 and then rotated so that the projections 27 slide under the lands 18 of the post 15. As the spike 12 rotates, the elastically deformable projections 27 deform as they slide past the ridges 36. Once past the ridges 36 the projections 27 return to their normal shape. The spike 12 cannot be removed from the post 15 by rotation, as the ridges 36 prevent the rotation of the spike 12, thus locking the spike 12 in place. In order to remove the spike 12 from the post 15 it is necessary to cause the elastic deformation of the spike 12 so that the projections 27 may again slide past the ridges 36 on the post 15.

In FIG. 15, an exploded view of a spike assembly 11 according to an embodiment of the present invention when viewed from below is shown. The post 15 comprises a hole 32 that engages with a protrusion (not shown) on the spike 12. The main shaft of the post 15 may be shaped such that when the spike 12 is connected to the post 15, the projections (not shown) on the spike 12 align with a pair of slots 33 located between a corresponding pair of ridges 36 adapted to retain the spike in place when in use. When connecting the spike 12 to the post 15, the elastically deformable projections (not shown) on the spike, will deform as they slide over the ridges 36, allowing the spike 12 to be rotated into place on the post 15. As the projections (not shown) slide past the ridges 36, the projections (not shown) will return to their undeformed state and will align with the pair of slots 33 in the post. Once connected in this manner, the spike 12 will be prevented from rotating, as the projections (not shown) will be held in place against the ridges 36. To remove the spike 12 from the post 15 it is necessary to elastically deform the spike 12 by applying pressure to the spike 12 in the direction indicated by the instructions 26. The projections (not shown) will be deformed, allowing the spike 12 to be rotated back past the ridges 36, enabling the spike 12 to be replaced.

FIG. 16 illustrates the sole 10 of a shoe with a plurality of posts 15 attached according to one embodiment of the present invention. The sole 10 is of a two part construction, comprising a hard skeleton 23 and a softer material 24 moulded around the skeleton 23.

FIG. 17 illustrates an exploded view of the sole 10 of a shoe according to one embodiment of the invention. In this embodiment, the mounting means comprises a plate 22 and post 15 formed separately from the skeleton 23, although in some embodiments of the invention, the mounting means may be formed integrally with the skeleton 23. The softer material 24 of the sole 10 may be moulded to comprise a number of raised features 34 adapted to engage with corresponding voids 35 in the skeleton 23, thus assisting in holding the skeleton 23 in place on the sole 10 of the shoe.

Figure 18:
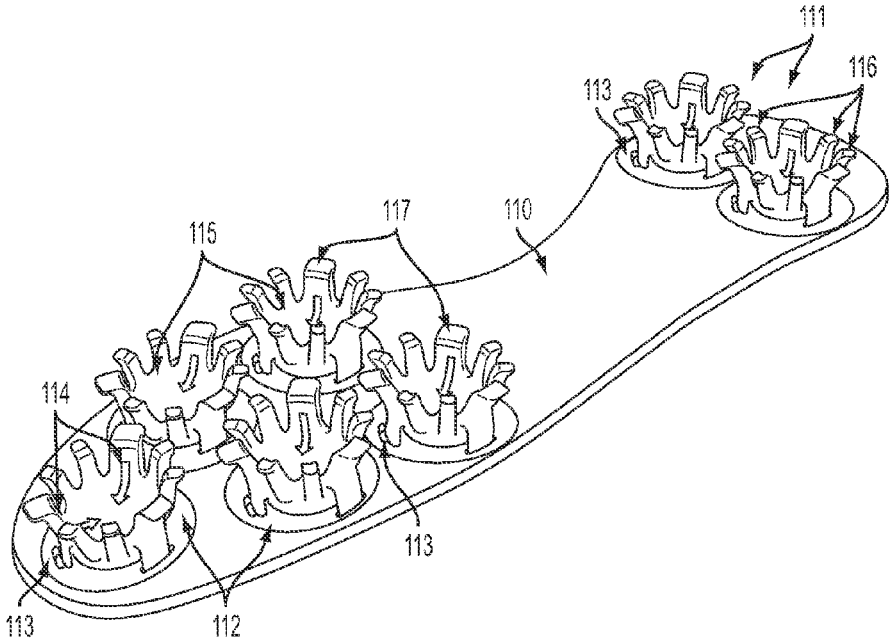
FIG. 18 illustrates a perspective view of the sole of a shoe including removable spikes or cleats according to an embodiment of the present invention.

In FIG. 18 there is shown a perspective view of a shoe sole 110 comprising a plurality of removable spike or cleat assemblies 111 according to an embodiment of the present invention.

The sole 110 is provided with a plurality of recesses (obscured) in which the base portion 112 of the mounting means is located and retained. Bach of the base portions 112 are provided with a plurality of apertures 113 into which the leg members 114 of the spike or cleats 115 are partially inserted in order to retain the spikes or cleats 115 in place on the mounting means.

Each spike or cleat 115 is provided with three leg members 114, and one end of each leg member 134 engages with an aperture 113 on the base portion 112. The other end of each leg member 114 is provided with a foot 117 adapted to engage with the ground when the shoe (not shown) is in use.

The spikes or cleats 115 also comprise a number of further projections 116 adapted to engage with the ground when the shoe (not shown) is in use. By providing a plurality of ground-engaging projections to complement the leg members 114, the spike or cleat assembly 111 provides the user with additional grip and stability.

Figure 19:
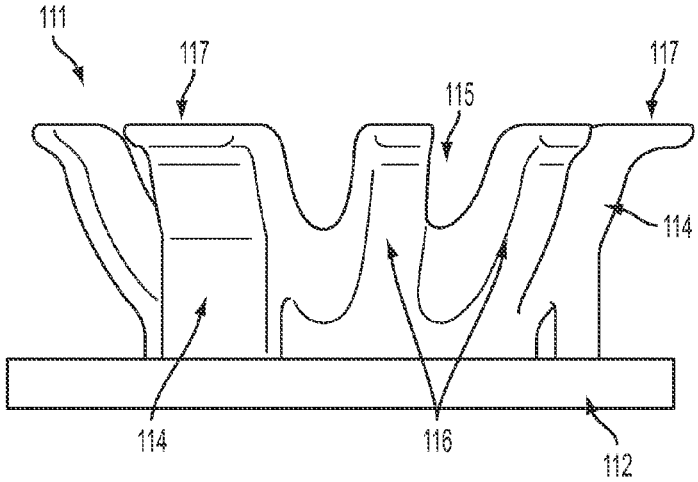
FIG. 19 illustrates a side view of a removable spike or cleat assembly according to an embodiment of the present invention.

In FIG. 19, a side view of a spike or cleat assembly 111 according to an embodiment of the invention is illustrated. The assembly 111 comprises a spike or cleat 115 and mounting means comprising a base portion 112 and a post (obscured) with which the spike or cleat 115 is engaged in use. The spike or cleat 115 comprises leg members 114 having ground-engaging feet 117 spaced apart from one another with ground-engaging projections 116 located interspaced between the leg members 114.

At the opposite end of the leg member 114 to the ground-engaging foot 117, the leg member is adapted for partial insertion into an aperture (obscured) located on the base portion 112. The leg members 114 are naturally biased such that the leg member 114 grips or contacts or abuts the edge of the aperture (obscured) and the spike or cleat 115 is retained in place on the base portion 112. When pressure pushing the leg member 114 inwardly towards the centre of the spike or cleat 115 is placed on or adjacent the foot 117, the natural bias of the leg member 114 is overcome and the leg member no longer grips the edge of the aperture (obscured). Once this occurs, the spike or cleat 115 may be disengaged from the base portion 112 and post (obscured).

Figure 20:
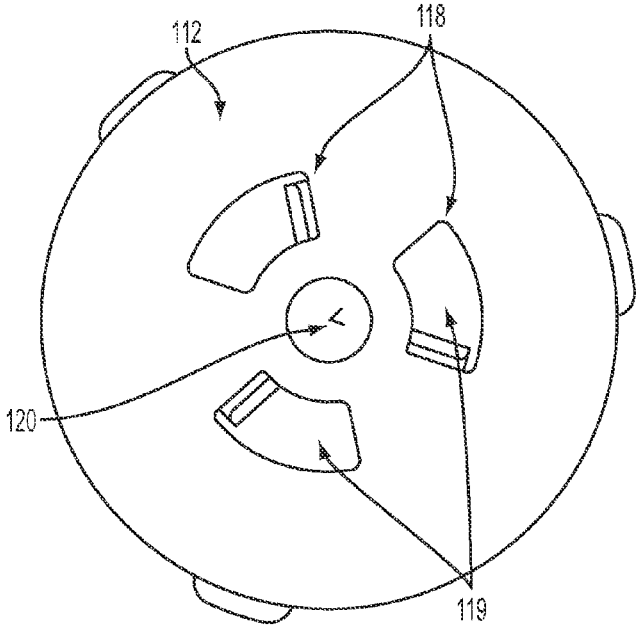
FIG. 20 illustrates an underneath view of a removable spike or cleat assembly according to an embodiment of the present invention.

Turning now to FIG. 20, an underneath view of the base portion 312 is shown. In this embodiment of the invention, the base portion 112 includes a number of cutaway portions 118 through which the projections 119 on the spike 115 can be seen in engagement with the projection (obscured) on the post (obscured). An indentation 120 showing the location of the post (obscured) on the reverse side of the base portion 112 may also be seen.

Figure 21:
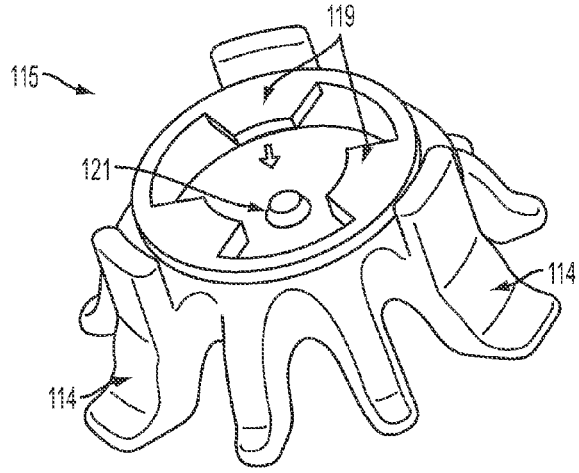
FIG. 21 illustrates a perspective view of a removable spike or cleat according to an embodiment of the present invention.

In FIG. 21, a spike or cleat 115 according to an embodiment of the present invention is shown. In this FIG., the ends of the leg members 114 adapted to insertion into the apertures on the base portion (not shown) may be more clearly seen. In addition, this FIG. clearly shows the projections 119 that, when the spike or cleat 115 is connected to the post (not shown), engage with corresponding projections (not shown) on the post (not shown) by sliding under the post projections (not shown) as the spike is rotated into engagement with the post (not shown).

The spike or cleat 115 further comprises alignment means 121 in the form of a small projection adapted to align with a complementary recess located on an upper portion of the post (not shown). By aligning the complementary alignment means, a user can ensure that the spike or cleat 115 and the post (not shown) are correctly aligned prior to engaging one with the other. In this manner, the engagement between the two components may be more easily achieved correctly at first attempt.

Figure 22:
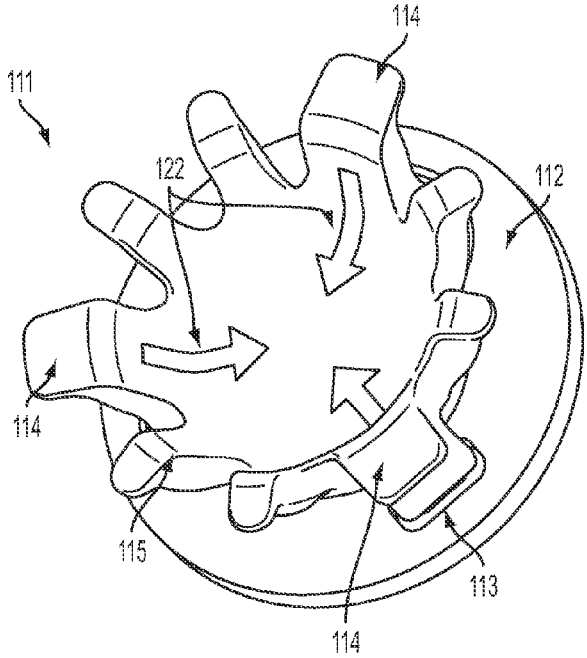
FIG. 22 illustrates a top perspective view of a removable spike or cleat assembly according to an embodiment of the present invention.

In FIG. 22, a perspective view of a removable spike or cleat assembly 111 is shown. In this FIG. it may be clearly seen that indicia in the form of arrows 122 have been provided on the spike or cleat 115. The arrows 122 are designed to indicate to the use the manner in which the spike or cleat 115 may be disengaged from the base portion 112. Specifically, the arrows 122 indicate that applying pressure to the leg members 114 in the direction indicated (i.e. towards the centre of the spike or cleat 115) will result in disengaging the leg members 114 from the apertures 113 in the base portion 112, thereby allowing the spike or cleat 115 to be removed for cleaning, repair or replacement.

Figure 23:
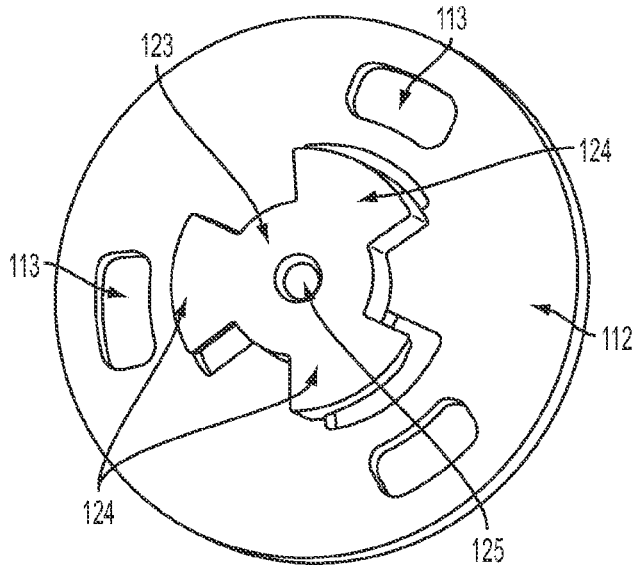
FIG. 23 illustrates mounting means according to an embodiment of the present invention.

FIG. 23 shows a view of the upper surface of the mounting means according to an embodiment of the present invention. The mounting means comprises a base portion 112 and a post 123 extending outwardly from the base portion 112. The post 123 is provided with three lands 124 under which the projections (not shown) on the spike or cleat (not shown) are adapted to come into sliding engagement with when the spike or cleat (not shown) is rotated into position on the post 123.

The upper surface of the post 123 is provided with alignment means in the form of a small recess 125 with which the complementary alignment means on the spike or cleat (not shown) is adapted to align.

In this Figure, the apertures 113 in which the leg members (not shown) are received may also be more clearly seen.

Figure 24:
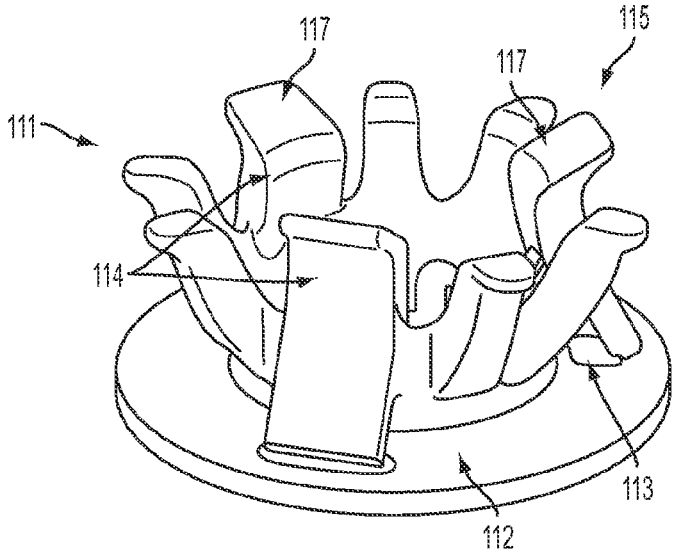
FIGS. 24-27 illustrate steps in the disengagement of a removable spike or cleat from mounting means according to an embodiment of the present invention.

FIG. 24 illustrates a first step in the process of disengaging the spike or cleat 115 from the mounting means. In this Figure it may be seen that pressure has been applied up the end of the leg members 114 adjacent the feet 117 such that the upper end of the leg members 114 are pushed inwardly towards the centre of the spike or cleat 115. This movement results in the lower end of the leg members 114 biasing outwardly and disengaging from the apertures 113 in the base portion 112.

It is envisaged that manual pressure on the leg members 114 will be sufficient to disengage the leg members 114 from the apertures 113. However, if a user has limited strength in their hands, or if the assembly 111 is difficult to remove (for instance, because it is heavily covered in mud or dirt), it is envisaged that a user may need to use a tool (such as a pair of pliers) to exert sufficient pressure on the leg members 114.

Figure 25:
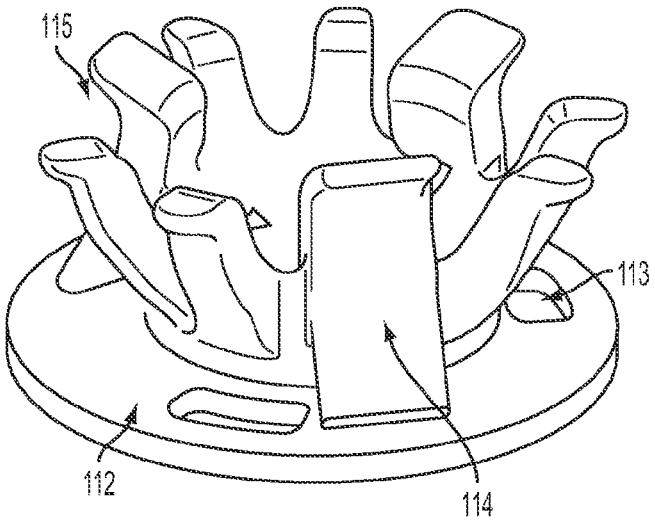

In FIG. 25, the second step in the process of disengaging the spike or cleat 115 from the mounting means is illustrated. In this step, the spike or cleat 115 has been rotated on the post (obscured) such that the projections (obscured) on the spike 115 and the lands on the post (obscured) disengage from one another. It may be seen in this Figure that the rotation of the spike or cleat 115 has resulted in the leg members 114 no longer being in alignment with the apertures 113 in the base portion 112. Once the leg members 114 have been disengaged from the apertures 113 and the projections (obscured) on the spike 115 have been disengaged from one another, the spike or cleat 115 is now ready to be removed, as shown in FIG. 26.

Figure 26:
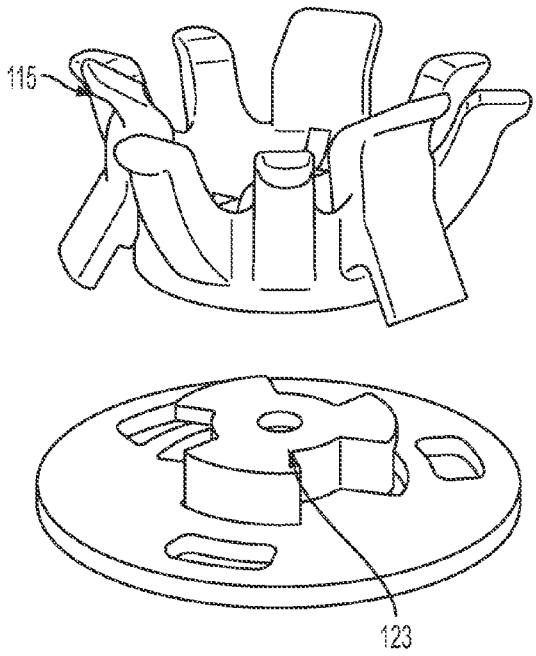
Figure 27:
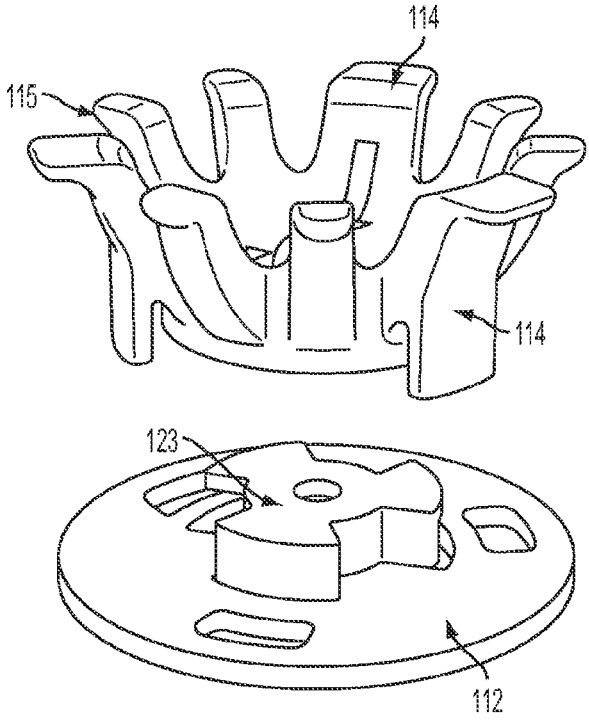

In FIG. 26, the spike or cleat 115 has now been lifted clear of the post 123, while in FIG. 27 the pressure applied to the leg members 114 has been released, and the leg members have again biased to their normal, non-elastically deformed position.

Once a spike or cleat 115 has been removed from the post 123 as shown in FIG. 27, the spike or cleat may be replaced (for instance, if the spike or cleat 115 has become worn or damaged), cleaned or repaired. Once the desired action has been carried out, a new spike or cleat (or the cleaned or repaired spike or cleat) may once again be engaged with the post 123 and base portion 112 by reversing the steps shown in FIGS. 24 to 27.

Throughout the specification and the claims (if present), unless the context requires otherwise, the term "comprise", or variations such as "comprises" or "comprising", will be understood to apply the inclusion of the slated integer or group of integers but not the exclusion of any other integer or group of integers.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

The invention claimed is:

1. A removable spike or cleat assembly for footwear, said footwear including a sole, wherein said assembly comprises: a spike or cleat constructed from an elastically deformable material and including one or more leg members and mounting means configured for engaging the sole, wherein the spike or cleat is configured for engaging a projection located on said mounting means, the engagement between the spike or cleat and the projection being achieved by rotating the spike or cleat relative to the projection and at least partially inserting the one or more leg members into one or more apertures located on the mounting means, and wherein the spike or cleat is disengaged from the mounting means by producing an elastic, radially inward deformation of the one or more leg members by a user towards a center of the spike or cleat.

2. The removable spike or cleat assembly according to claim 1, wherein the projection located on the mounting means is a post.

3. The removable spike or cleat assembly according to claim 2, wherein the post comprises one or more land portions adapted for engagement with one or more projections located on the spike or cleat.

4. The removable spike or cleat assembly according to claim 1 wherein the spike or cleat is in a non-elastically deformed state when engaged with the mounting means.

5. The removable spike or cleat assembly according to claim 1, wherein the one or more leg members comprise an elongate member.

6. The removable spike or cleat assembly according to claim 5, wherein the elongate member has a first end adapted for engagement with the ground when the spike or cleat is in use and a second end adapted for at least partial insertion into the one or more apertures located on the mounting means, said first end being subject to said deformation.

7. The removable spike or cleat assembly according to claim 1, wherein the one or more apertures on the mounting means are located in a base portion of the mounting means.

8. The removable spike or cleat assembly according to claim 1, wherein the spike or cleat comprises one or more pressure point.

9. The removable spike or cleat assembly according to claim 8, wherein the one or more pressure points are located on the one or more leg members.

10. The removable spike or cleat assembly according to claim 9, wherein the application of sufficient pressure to the one or more pressure points overcomes the natural bias of the one or more leg members to facilitate the disengagement of the spike or cleat from the mounting means.

11. The removable spike or cleat assembly according to claim 1, wherein the one or more leg members are provided with a natural bias such that, in use, the one or more leg members engage an edge of the one or more apertures with sufficient force to retain the one or more leg members within the one or more apertures.

12. The removable spike or cleat assembly according to claim 1, wherein the spike or cleat is provided with indicia adapted to indicate the correct manner of disengaging the spike or cleat from the mounting means.

13. The removable spike or cleat assembly according to claim 12, wherein the indicia comprises one or more symbols, letters, numbers, pictures, or any combination thereof.

14. The removable spike or cleat assembly according to claim 1 wherein the spike or cleat comprises at least one further projection for engaging with the ground when the shoe is in use.

* * * * *